US005281076A

United States Patent [19]

Lehman

[11] Patent Number: 5,281,076

[45] Date of Patent: Jan. 25, 1994

[54] FORKLIFT ATTACHMENT

[75] Inventor: Marcus S. Lehman, Lake City, Minn.

[73] Assignee: Liberty Diversified Industries, Minneapolis, Minn.

[21] Appl. No.: 66,408

[22] Filed: May 24, 1993

Related U.S. Application Data

[63] Continuation of Ser. No. 697,258, May 8, 1991, abandoned.

[51] Int. Cl.[5] ..... B66F 9/18

[52] U.S. Cl. ..... 414/607; 414/419; 414/620; 414/621

[58] Field of Search ..... 414/419–422, 414/425, 620–621, 639–642, 663, 607

[56] References Cited

U.S. PATENT DOCUMENTS

| | | | |
|---|---|---|---|
| 1,646,815 | 10/1927 | Glassen . | |
| 2,603,368 | 7/1952 | Vance | 414/620 |
| 2,645,372 | 7/1953 | Broersma . | |
| 2,704,167 | 3/1955 | Framhein . | |
| 2,754,018 | 7/1956 | Schroeder | 414/620 |
| 2,826,322 | 3/1958 | Posehn . | |
| 2,842,275 | 7/1958 | Kughler . | |
| 2,971,662 | 2/1961 | Dunham . | |
| 2,984,985 | 5/1961 | MacMillin | 414/620 X |
| 3,179,274 | 4/1965 | Comfort | 414/620 |
| 3,180,512 | 4/1965 | Moss . | |
| 3,180,514 | 4/1965 | Horton | 414/620 |
| 3,206,052 | 9/1965 | Kennedy | 414/620 X |
| 3,227,299 | 1/1966 | Draxler | 414/621 |
| 3,319,815 | 5/1967 | Vik . | |
| 3,410,431 | 11/1968 | Vik . | |
| 3,438,523 | 4/1969 | Vik . | |
| 3,438,669 | 4/1969 | Vik . | |
| 3,448,880 | 6/1969 | Howard . | |
| 3,472,404 | 10/1969 | Ord . | |
| 3,506,148 | 4/1970 | Vik . | |
| 3,512,670 | 5/1970 | Howard . | |
| 3,876,100 | 4/1975 | Brudi et al. | 414/641 X |
| 3,881,761 | 5/1975 | Meyer et al. . | |
| 3,893,579 | 7/1975 | Glewwe . | |
| 3,971,485 | 7/1976 | Hoppey . | |
| 4,029,230 | 6/1977 | Bolduc . | |
| 4,130,212 | 12/1978 | Gatilao . | |
| 4,160,620 | 7/1979 | Farmer et al. | 414/621 |
| 4,161,256 | 7/1979 | Seaberg | 414/620 |
| 4,304,433 | 12/1981 | Langowski | 294/106 |
| 4,318,661 | 3/1982 | Helm | 414/607 |
| 4,385,860 | 5/1983 | Corbin | 414/420 |
| 4,516,905 | 5/1985 | Cavin et al. | 414/621 X |
| 4,618,306 | 10/1986 | Dorsch | 414/420 |
| 5,009,565 | 4/1991 | Esau | 414/607 |

FOREIGN PATENT DOCUMENTS

| | | |
|---|---|---|
| 2533202 | 3/1984 | France . |
| 1407894 | 7/1988 | U.S.S.R. . |

OTHER PUBLICATIONS

Liftomatic SDXA Drum Dumper Brochure, Apr. 7, 1988.

Little Giant Attachments Brochure, Oct. 20, 1975.

Brochure of Liftomatic Material Handling, Inc. showing an DSXA Automatic Drum Dumper.

Brochure of Liftomatic Material Handling, Inc. showing a Drum Dumper.

*Primary Examiner*—Michael S. Huppert
*Assistant Examiner*—James Keenan
*Attorney, Agent, or Firm*—Merchant, Gould, Smith, Edell, Welter & Schmidt

[57] ABSTRACT

An attachment is provided for a forklift. The attachment including a frame having a mechanism for attaching said frame to the forks of a forklift. A carriage assembly is provided including a carriage frame and drum engaging member. The carriage frame is connected to the main frame for pivotable movement about a horizontal axis of rotation. The drum engaging member is connected to the carriage frame for rotational movement about the axis of rotation. The drum engaging member includes first and second clamps mounted on the drum engaging member for movement relative to one another between open and closed positions.

9 Claims, 5 Drawing Sheets

FORKLIFT ATTACHMENT

This is a continuation of application Ser. No. 07/697,258, filed May 8, 1991, abandoned.

BACKGROUND OF THE INVENTION

1. Field of the Invention

This invention pertains to an attachment for forklifts. More particularly, this invention pertains to a forklift attachment which enables the lifting and handling of cylindrical drums.

2. Description of the Prior Art

In the prior art, many attachments have been proposed to enable a forklift truck to handle cylindrical drums. See for example, U.S. Pat. Nos. 5,009,565; 3,971,485; 3,512,670; 2,842,275; and 3,410,431.

In constructing a forklift attachment for handling drums, it is necessary to provide a design which is of low cost manufacture and reliable performance. It is one of the objects of the present invention to meet this need.

II. SUMMARY OF THE INVENTION

According to a preferred embodiment of the present invention, an attachment is provided for a forklift. The attachment includes a main frame having means for attaching the main frame to the forks of a forklift. A carriage assembly is provided including a carriage frame and a drum engaging member. The carriage assembly is connected to the main frame for the carriage assembly to pivot about a horizontal axis. The drum engaging member is connected to the carriage frame for pivotable movement about a second axis of rotation. The second axis is generally perpendicular to the horizontal axis. The drive engaging member includes first and second clamps which are mounted on the drive engaging member to be moved relative to one another between an open position and a closed position. In the open position, the clamps are spaced apart sufficient to receive a drum of predetermined dimensions. In a closed position, the clamps are spaced apart in a distance sufficient to grasp and carry the drum.

III. BRIEF DESCRIPTION OF THE DRAWINGS

IV. DESCRIPTION OF THE PREFERRED EMBODIMENT

Figure 1:
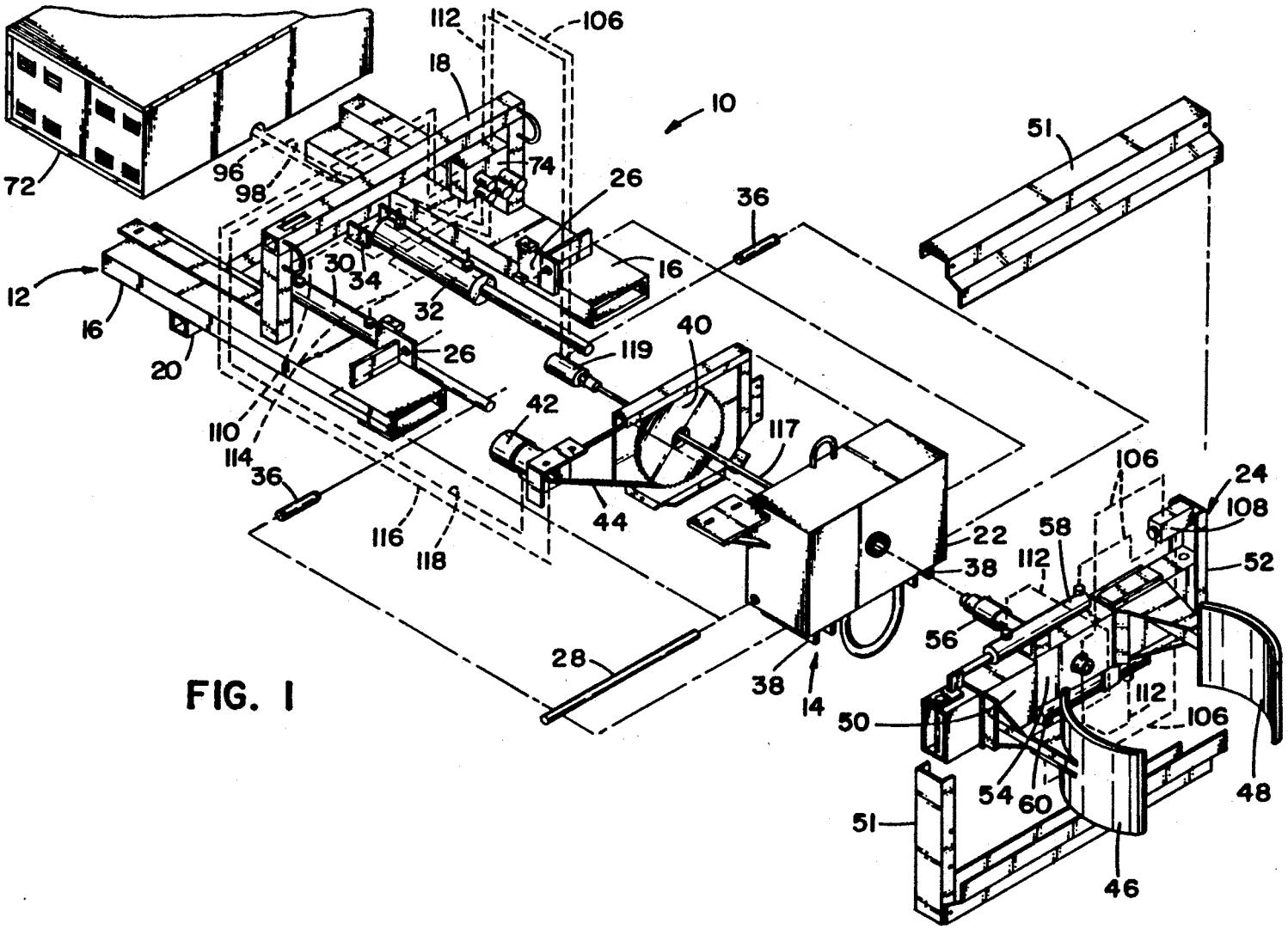
FIG. 1 is an exploded perspective view showing an attachment for forklifts according to the present invention.

Referring now to the several drawing figures in which identical elements are numbered identically throughout, a forklift attachment 10 is shown for attachment to a forklift (not shown). The attachment 10 includes a main frame 12 and a carriage assembly 14.

The main frame 12 includes a pair of parallel spaced apart channel members 16 connected to one another by an upper bracing 18 and a lower bracing 20. The channel members 16 are hollow and are sized and spaced apart by predetermined amounts sufficient to permit the forks (not shown) of a forklift to be slidably received within the channel member 16 such that the frame 12 may be raised or lowered with the raising or lowering of the forks of the forklift.

The carriage assembly 14 includes a carriage frame or housing 22 and a drum engaging member 24. The carriage frame 22 is pivotally connected to main frame 12 for the carriage frame 22 to pivot about a generally horizontal axis. Each of channel members 16 is provided with a mounting bracket 26. A pivot rod 28 extends through carriage frame 22 and is received within aligned holes of mounting brackets 26. Accordingly, the carriage frame 22 pivots about rod 28 relative to frame 12.

Hydraulic cylinders 30 and 32 are provided as a source of motive power to pivot carriage frame 22 about rod 28. The cylinder ends of each of cylinders 20,32 are connected to lower brace 20 by mounting brackets 34. The piston ends of cylinders 30,32 are pivotally connected to the carriage frame 22 by means of pivot pins 36 extending through the piston ends of cylinders 30,32 with the pins 36 received within aligned holes of mounting brackets 38 carried on carriage frame 22. Accordingly, extension of the piston ends of the cylinders 30,32 results in movement of the carriage frame 22 to an "up-tilt" position (as shown in solid lines in FIG. 2). Retraction of the piston ends of cylinders 30,32 results in pivotable movement of the carriage frame 22 about the pivot rod 28 to a "down-tilt" position (as shown in the phantom lines of FIG. 2).

Carriage frame 22 includes a rotary mounted sprocket 40 carried on frame 22 for rotation about an axis of rotation. A rotary hydraulic motor 42 is also carried on carriage frame 22 and is connected by a chain 44 to sprocket 40 for sprocket 40 to rotate in response to actuation of motor 42. It will be appreciated that motor 42 is a commercially available item and can drive sprocket 40 both in a clockwise and counterclockwise direction.

The drum engaging member 24 includes first and second clamps 46,48 carried on telescoping beams 50 and 52 surrounded by a frame 51. The beam 50 is slidably received within beam 52 and both beams 50 and 52 move relative to one another with first and second clamps 46,48 movable toward and away from one another. The beams 50,52 are connected to a common stationary member 54.

Member 54 is connected to a shaft 56 which is also connected to sprocket 40 for rotation therewith. Accordingly, drum clamping member 24 pivots about the axis of shaft 56 upon rotation of sprocket 40.

For reasons that will become apparent, a hydraulic distribution line 117, having a distribution head 119, extends through shaft 56. This line 117 permits hydraulic line 106,112 to connect to cylinders 58,60, as will be described.

Third and fourth hydraulic cylinders 58,60 are carried on drum clamping members 46, 48. The cylinder head ends of the cylinder 58,60 are connected to clamping members 46, 48. The piston ends of the cylinders 58,60 are connected to the beam 54. Accordingly, extensions of the piston ends of cylinders 58,60 results in movement of clamps 46,48 towards one another. Conversely, retraction of the pistons of cylinders 58,60 results in clamps 46 and 48 moving away from one another.

The stroke of cylinders 58,60 is selected for the clamps 46,48 to move between open and closed positions. At the open positions, the clamps 46,48 are spaced apart a distance sufficient for a drum of known dimensions to be received between the clamps 46,48. In a closed position, the clamps 46,48 are spaced apart a distance sufficient for the clamps 46,48 to grasp a drum received between the clamps 46,48.

Figure 2:
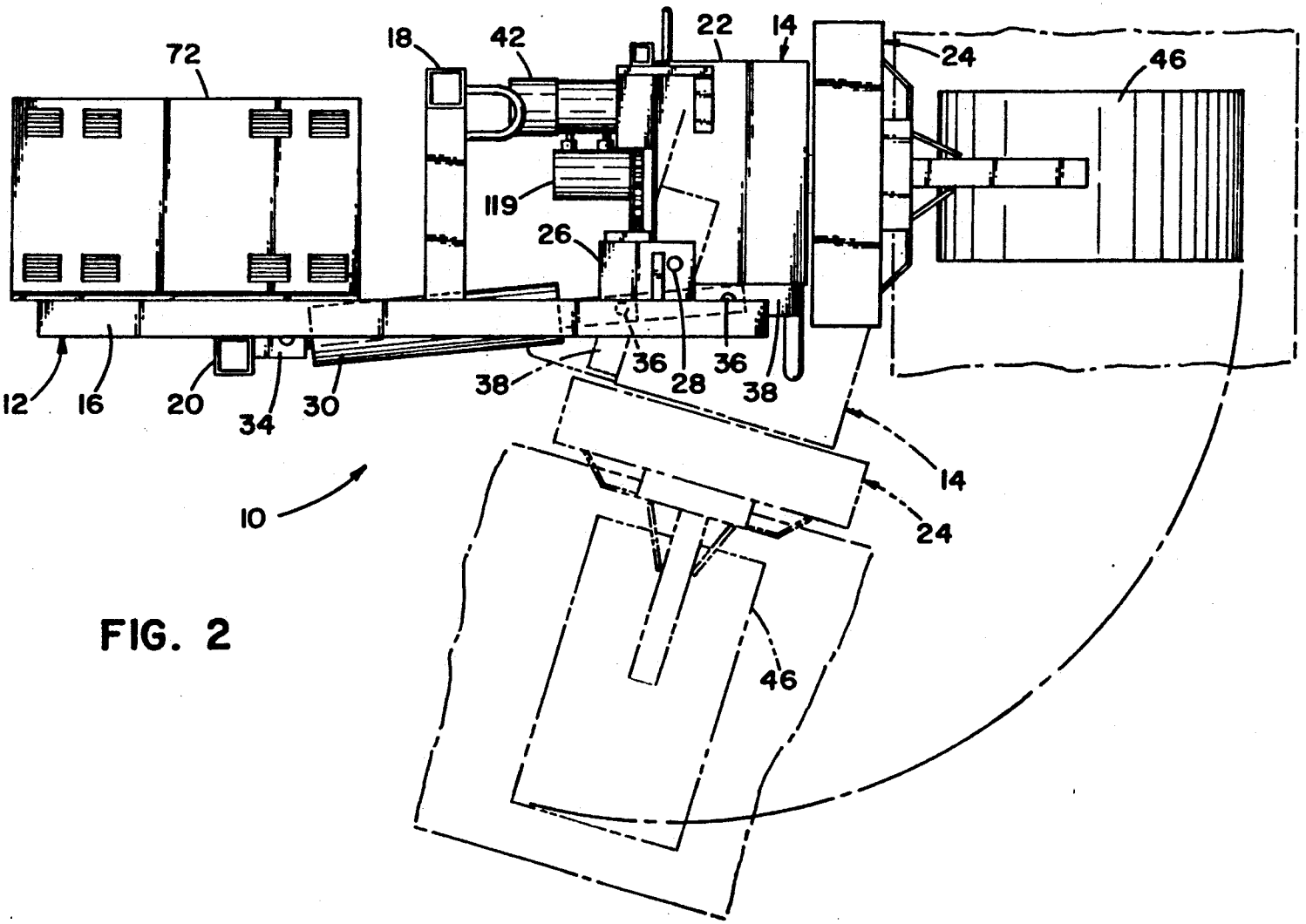
FIG. 2 is a side view, taken in elevation, of the attachment of the present invention showing a carriage assembly in two alternative positions.
Figure 3:
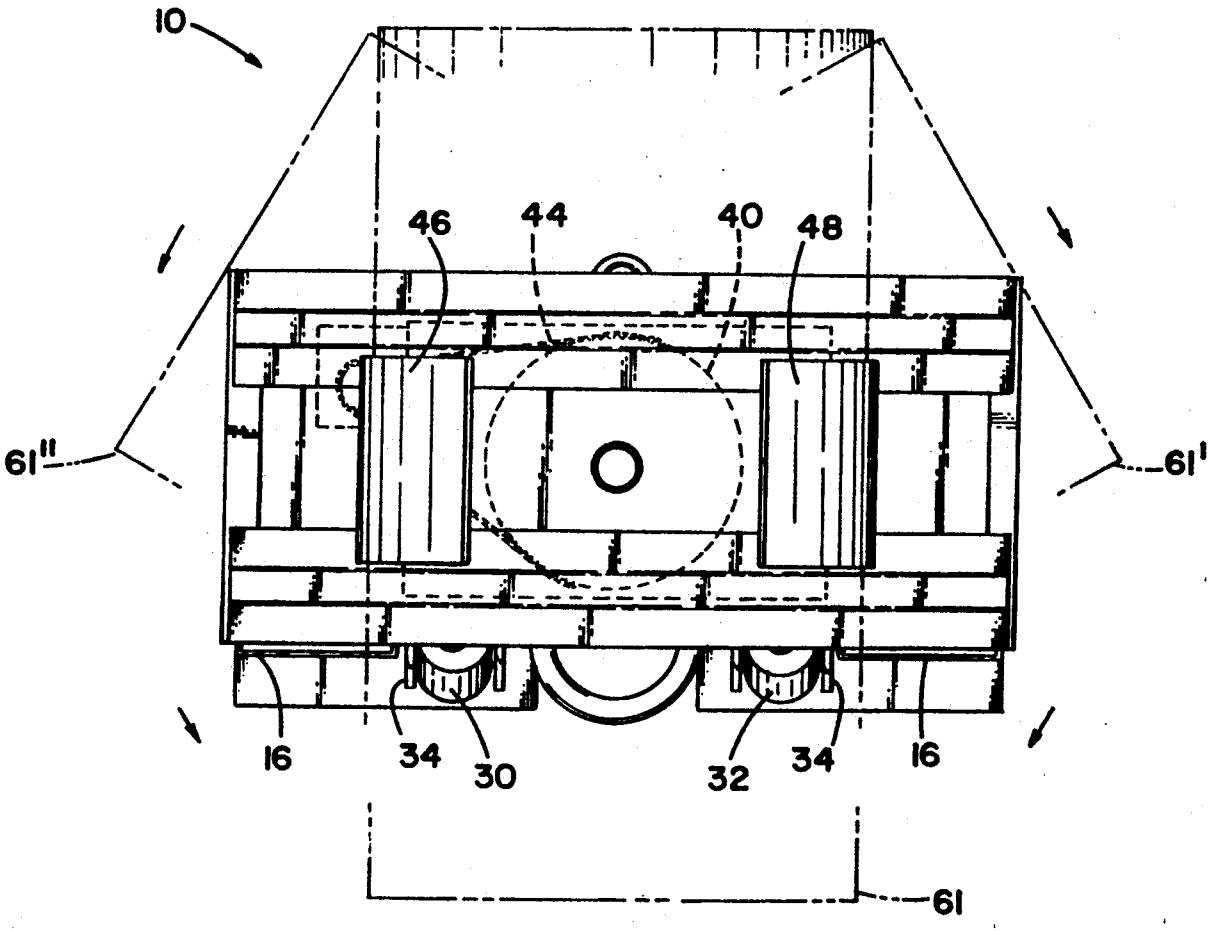
FIG. 3 is a front elevation view of the attachment of the present invention showing a drum engaging member in three positions.

From the description thus far provided, the drum and forklift attachment 10 of the present invention is shown to have four degrees of movement. First, the entire attachment 10 can be raised or lowered by operation of the forks (not shown) or a forklift (not shown). The vertical movement with a forklift permits stacking of the drums as shown by the solid line in FIG. 2. In addition, the entire carriage assembly 14 (which includes the drum engaging member 24) tilts or pivots about the axis of rod 28. As shown by the phantom lines in FIG. 2, this permits an operator to dump forward (i.e., dump material out of a drum in a forward direction). A third degree of movement is provided by the pivoting of the drum engaging member 24 about the axis of shaft 56. As shown in FIG. 2, this permits a drum to be completely inverted (shown by drum 61 in FIG. 3), dumped to the right (drum 61' in FIG. 3) or dumped to the left (drum 61'' in FIG. 3). Finally, the fourth degree of movement is provided by the relative movement of the clamps 46,48 which permits the drum to be grasped or released.

Figure 4:
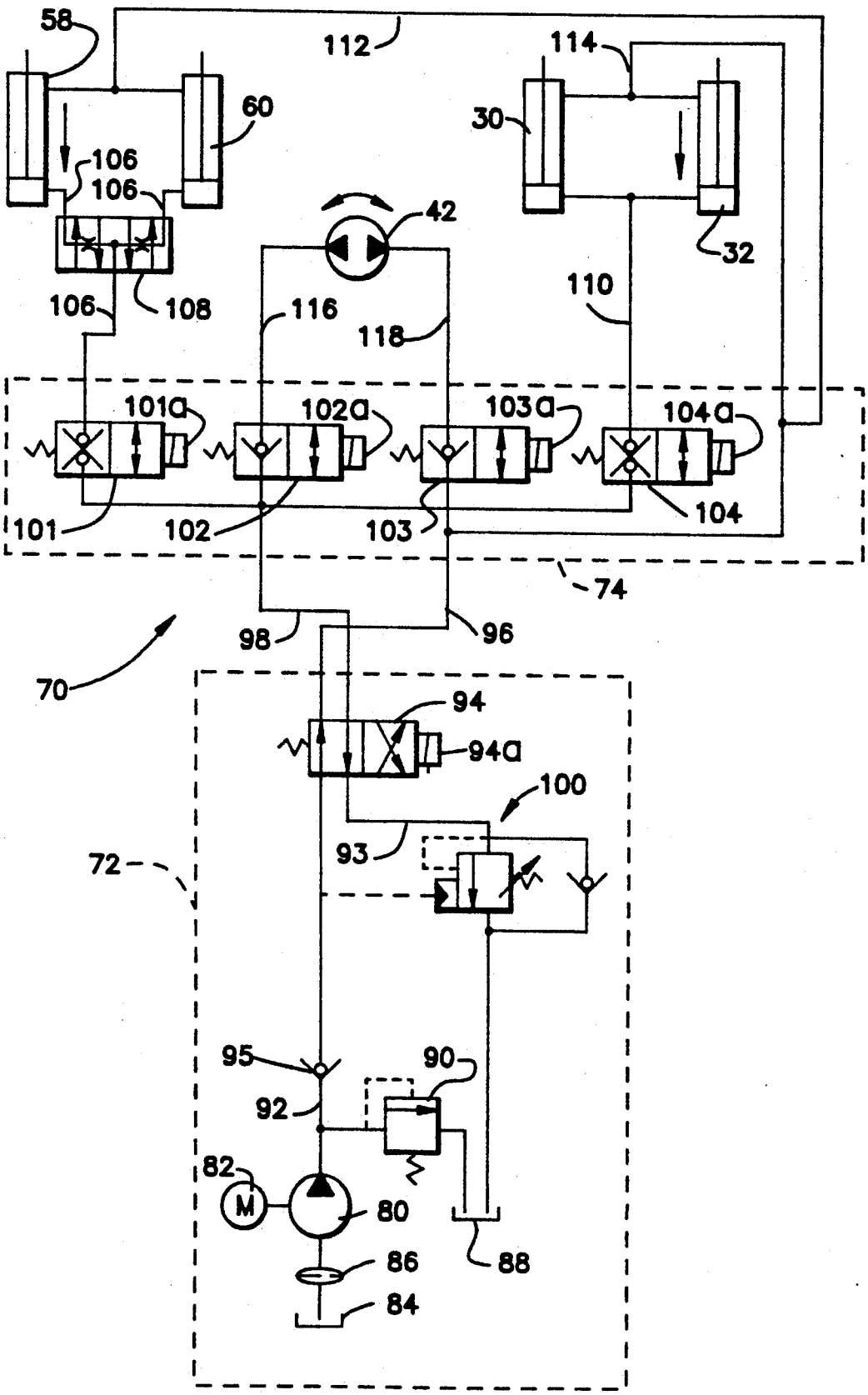
FIG. 4 is a schematic representation of the hydraulic circuitry of the attachment of the present invention.

In FIG. 4, the hydraulic circuitry 70 is schematically shown. The circuitry 70 includes the hydraulic circuitry contents of a control housing 72, and a hydraulic control block 74.

The hydraulic contents of the control housing 72 include a pump operated by a motor 82. The pump is connected to a reservoir 84 with a filter 86 disposed between the reservoir 84 and the pump 80. A return reservoir 88 (which in practice is preferably the same as reservoir 84) is provided. A pressure relief 90 connects a pressurized line 92 to reservoir 88. It will be appreciated that a pressure relief such as pressure relief 90 is well known in the art and is commercially available. A check valve 95 is provided in pressure line 92.

A main directional control valve 94 is provided in directing pressurized hydraulic fluid between first and second distribution lines 96,98. Valve 94 is biased as shown for directing pressurized fluid from pressure line 92 to first distribution line 96. Upon energization of solenoid 94*a*, valve 94 shifts against its bias for pressurized line 92 to be connected to second distribution line 98. An overload control 100 is commercially available and, in response to pressure in line 92 exceeding a predetermined set pressure, control 100 adjusts flow rate through return line 93 to keep the pressure in line 92 below a predetermined maximum pressure.

The control block 74 includes four valves 101–104. Each of valves 101–104 is a two position valve biased to their second positions upon energization of solenoids 101*a*–104*a*, respectively. In the biased positions, valves 101,104 block flow through the valves 101,104 in any direction. Upon energization of solenoids 101*a*, 104*a*, valves 101,104 are shifted to their second positions where fluid flow may pass through the valves 101,104 in either direction. Valves 102,103, in the biased state as shown, permit fluid flow through the valves 102,103 toward rotary hydraulic motor 42 but prevent flow from motor 42 back through the valves 102,103. Upon energization of solenoids 102*a*, 103*a*, valves 102,103 are shifted to their second positions whereby fluid flow may pass through the valves 102,103 in either direction. First distribution line 96 is connected to valve 103. Second distribution line 98 is connected to valves 101,102 and 104.

As indicated, valves 102,103 control operation of rotary motor 42. Valve 101 controls operation of cylinders 58,60. Valve 104 controls operation of cylinders 30,32.

A first cylinder head pressure line 106 connects valve 101 to the cylinder head end of pistons 58,60. Disposed within line 106 is a flow divider 108. Flow divider 108 is a commercially available item and insures even flow from line 1–6 to both of cylinders 58,60. The use of a flow divider 108 is necessary since cylinders 58,60 are not mechanically linked but are required to move at generally the same rates of movement.

A second cylinder head line 110 connects valve 104 to the cylinder heads of cylinders 30,32. Since cylinders 30,32 are mechanically linked (i.e. both are connected to the carriage frame 22), a flow divider is not required in line 108. A first rod end line 112 connects the rod ends of cylinders 58,60 to first distribution line 96. Similarly, a second rod end line 114 connects the piston rod ends of cylinders 30,32 to first distribution line 96.

A first motor supply line 116 connects valve 102 to one side of rotary motor 42. A second line 118 connects a second side of rotary hydraulic motor 42 to valve 103.

With a hydraulic circuit 70 as disclosed, cylinders 58,60 extend (resulting in closing of clamps 46,48) when valve 101 is shifted to its second position and when valve 94 is shifted to its second position.

Cylinders 30,32 expand (resulting in a tilt-up position) when valve 104 is shifted to its second position and when valve 94 is shifted to its second position. Cylinders 30,32 contract (resulting in a tilt-down position) when valve 104 is shifted to its second position and when valve 94 is in its first position. Rotary hydraulic motor 42 rotates right when both valves 102,103 are shifted to their second position. Motor 42 rotates left when both valves 102,103 are shifted to their second position and when valve 94 is in its first position.

From the foregoing, it will be appreciated by those skilled in the art that valve 94 controls the direction of movement of cylinders 58,60,30,32 and motor 42. Valves 101–104 control on/off operation of the cylinders 58,60,30,32 and motor 42.

In operation, it is desirable that certain actions be precluded while other operations are proceeding. For example, it is desirable that while the clamps 46,48 are being moved, the attachment 10 will not tilt or rotate.

Figure 5:
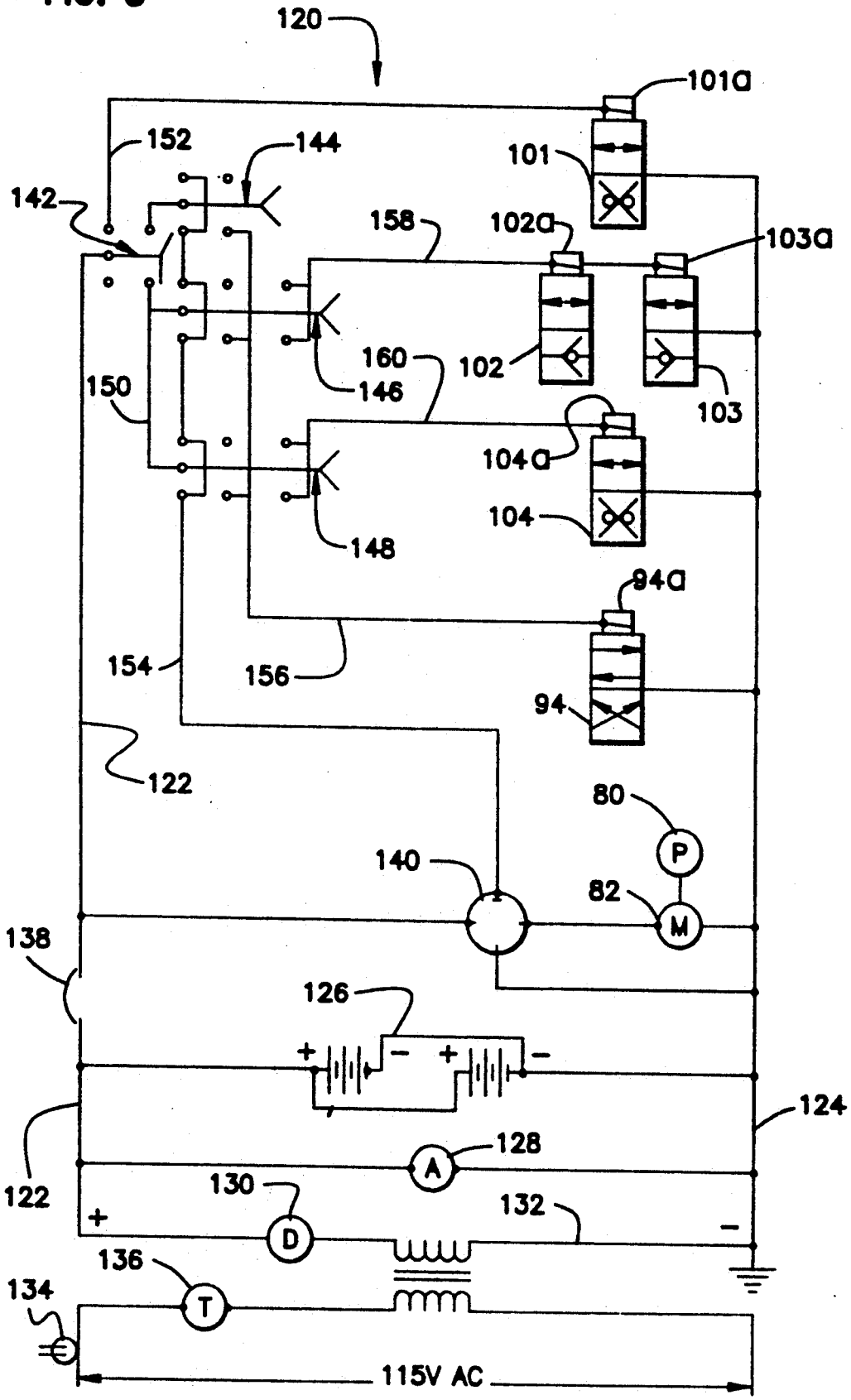
FIG. 5 is a schematic representation of the electronic circuitry of the attachment of the present invention.

FIG. 5 shows an electronic circuit 120 for controlling the hydraulic circuit 70 of FIG. 4. The electronic circuit 120 include an energized line 122 and a grounded line 124. A battery assembly 126 provides a potential across lines 122,124. An ammeter 128 permits an operator to visually inspect current flow through the circuit 120. A diode 130 is provided to insure desired current directional flow. A charging system is provided in the form of a transformer 132 which has a wall plug 134 and a timer 136. The timer 136 can be set to a desired charging time for the battery 126. A circuit breaker 138 is provided in the energized line 133.

A solenoid 140 is provided for starting motor 82 which operates hydraulic pump 80. Four operator engageable switches are provided. They include a first clamp switch 142, a second clamp switch 144, a rotate switch 146 and a tilt switch 148. Switches 144,146 and 148 are commercially available items and are well known and so-called "rocker" switches. Switches 144,146 and 148 are shown in their rest or neutral states.

Switch 142 is a switch biased as shown in FIG. 5 to connect energized line 122 to first distribution line 150. Upon actuation by an operator, switch 142 is shifted against its bias to a second position to connect switch 144 and a second distribution line 152 to energized line 122.

Second clamp switch 144 is shown in its normal neutral position. At the option of an operator, second clamp switch 144 may be shifted to a second position, in the upward direction of FIG. 5, to connect the second clamp switch 144 to a third distribution line 154. Alternatively, an operator can urge second clamp switch 144 to its third position (in a downward direction in FIG. 5) which connects the second clamp switch 144 to both the third distribution line 154 and a fourth distribution line 156.

Rotate switch 146 is shown in its rest or neutral position. Rotate switch 146 may be shifted to its second position (in the upward position of FIG. 5) to connect first distribution line 150 with both third distribution line 154 and a fifth distribution line 158. If rotate switch 146 is shifted to its third position (in a downward direction of FIG. 5), line 150 is connected to third, fourth and fifth distribution lines 154,156,158. Accordingly, switch 146 operates the rotate solenoids 102,103 regardless of the direction in which the operator throws switch 146. However, when thrown in the down position, rotate switch 146 causes valve 94 to shift positions (thereby changing the direction of rotation of motor 42).

Switch 148 is shown in its rest position. Switch 148 may be thrown by an operator to its second position to electrically connect first distribution line 150 with third distribution line 154 and a sixth distribution line 160. When thrown to its second position (shown in the upward direction of FIG. 5), the switch 148 does not connect with fourth distribution line 156. That connection is made upon throwing the switch 148 to its third position (in the downward direction of FIG. 5).

From the foregoing, it can be seen how first clamp switch 142 acts as a safety interlock. Namely, the switch 142 must be in the position shown to operate rotation or tilting functions. When in a position necessary to operate the rotation or switching functions, the clamp function is not operational. The clamp function is only operational by throwing the first clamp switch 142 to its second position at which point the rotation and tilt functions are not operational. When in its second position, first clamp switch 144 energizes solenoid **101*a* to throw valve 101 to its second position. Operation of switch 144 starts movement of the clamp by energizing motor start solenoid 140 regardless of the direction in which switch 144 is thrown. If switch 144 is thrown up, directional control valve 94 stays in the biased position shown in FIG. 5. If switch 144 is thrown down, solenoid 94*a* is energized switching the direction of valve 94 (thereby switching the direction of movement of the clamps). Accordingly, both switches 142 and 144** must be simultaneously activated in order to open or close the clamps. This results in a two-handed operation by an operator to insure that the operator is not engaged in other functions while loading or unloading a drum.

With switch 142 in its rest position (as shown in FIG. 5), the clamps are not operational and an operator can activate either of the rotate or tilt functions. To rotate a drum, the operator throws rotate switch 146 to its first position (in the upward direction of FIG. 5). This energizes solenoids **102*a*,103*a* and shifts valves 102,103 to their operational mode. When in this position, rotate switch 146 does not connect to fourth distribution line 156. Accordingly, valve 94 is in its rest direction as shown in FIGS. 4 and 5. If rotate switch 146 is shifted to its third position (the downward position of FIG. 5), solenoids 102*a*,103*a* and 94*a* are all energized resulting in shifting of valves 102,103 and 94**. This results in reversal of the rotational direction.

When operating tilt switch 148, the switch is thrown in the upward direction of FIG. 5 to energize solenoid **104*a* and shift valve 104 to its operational state. In this position, solenoid 94*a* is de-energized and valve 94 is in its rest state. To reverse direction of tilt, the switch 148 is thrown in the downward direction of FIG. 5 to energize both solenoid 94*a* and 104*a* resulting in a shifting of both valves 94 and 104**.

From the foregoing description, it has been shown how solenoids 101–104 are activated to place the clamping operation, rotating operation and tilt operation in the operational mode. Further, by selecting the direction of throw of clamp switches 144,146 and 148, valve 94 may be selectively shifted to control direction of the movement of the clamping, rotating or tilting operations. Regardless of the direction in which valves 144,146 and 148 are thrown, the motor solenoid 140 is energized to activate the motor 82 and pump 80.

As a result of the structure and operation of the present invention as described, a functionally desirable and economical forklift attachment has been shown for use in lifting drums or the like. The attachment includes functions for tilting, rotating and grasping of a drum. Each of the functions is independently operational. The hydraulic and electrical circuit for operating the system provides for safe operation and simplified control with a hydraulic circuit having a minimum number of valves.

Having shown how the objects of the invention have been attained in a preferred manner, modifications and equivalents of the disclosed concepts will become readily apparent to one skilled in the art. It is intended that the scope of the present invention not be limited to the specific embodiment shown. Instead, it is intended that the scope of the present invention shall include such modifications and equivalents.

What is claimed is:

1. An attachment for a forklift comprising:

a main frame having attachment means defining pockets sized for removably receiving the forks of a forklift;

a carriage assembly including a carriage frame and an object engaging member;

said carriage frame connected to said main frame for pivotable movement of said carriage frame about a generally horizontal first axis relative to said main frame and said attachment means, said first axis generally transverse to said forks upon attachment of said frame to said forks;

said object engaging member pivotally connected to said carriage member for pivotable movement about a second axis of rotation generally perpendicular to said first axis, said object engaging member secured to said carriage member for pivotal movement therewith about said first axis as said carriage member pivots about said first axis;

said object engaging member including first and second clamps mounted on said member and moveable between an open position and a closed position, said clamps in said open position spaced apart a distance sufficient to receive an object of predetermined dimensions, said clamps in said closed position spaced apart a distance sufficient to grasp said object;

motive power means including a first actuator for operably moving said carriage frame about said first axis, said motive power means further including a second actuator for operably moving said object engaging member about said second axis and said motive power means still further including a third actuator for moving said clamps between said open and closed positions at an option of an operator, said motive power means carried on said attachment and independent of a power source of said forklift; and said second and third actuators secured to said carriage frame for movement therewith about said first axis, said first actuator secured to said main frame for movement therewith.

2. An attachment according to claim 1 wherein said clamps are mounted for lateral movement relative to one another.

3. An attachment according to claim 1 wherein said actuators are hydraulic actuators.

4. An attachment mechanism according to claim 3 wherein said hydraulic actuators are governed by a hydraulic power system having a plurality of valves including valve means for separately shifting said first, second and third hydraulic actuators between operational modes.

5. An attachment according to claim 4 wherein said hydraulic circuit further includes a master valve for shifting a direction of movement of said first, second and third hydraulic actuators.

6. An attachment according to claim 4, wherein said hydraulic circuit includes means for operating said third actuator only when said first actuator and said second actuator are in a non-operational mode.

7. An attachment according to claim 1 wherein said third actuator is carried on said object engaging member for movement therewith.

8. An apparatus according to claim 1 wherein said first actuator is carried on said main frame for movement therewith and connected to said carriage frame for urging said carriage frame to pivot about said first axis.

9. An attachment for a forklift comprising:

a main frame having attachment means defining pockets for removably receiving the forks of a forklift;

a carriage assembly including a carriage frame and an object engaging member;

said carriage frame connected to said main frame for pivotable movement of said carriage frame about a generally horizontal first axis relative to said main frame and said attachment means with said first axis generally transverse to said forks;

an object engaging member pivotally connected to said carriage member for pivotable movement about a second axis of rotation generally perpendicular to said first axis, said object engaging member secured to said carriage member for pivotal movement therewith about said first axis as said carriage member pivots about said first axis;

said object engaging member including first and second clamps mounted on said member and moveable between an open position and a closed position, said clamps in said open position spaced apart a distance sufficient to receive an object of predetermined dimensions, said clamps in said closed position spaced apart a distance sufficient to grasp said object;

motive power means including a first actuator for operably moving said carriage frame about said first axis, said motive power means further including a second actuator for operably moving said object engaging member about said second axis and said motive power means still further including a third actuator for moving said clamps between said open and closed positions at an option of an operator;

said attachment including a main housing connected to said main frame and containing a source of power for said motive power means; and said second and third actuators secured to said carriage frame for movement therewith, said first actuator secured to said main frame for movement therewith.

* * * * *

UNITED STATES PATENT AND TRADEMARK OFFICE

CERTIFICATE OF CORRECTION

PATENT NO. : 5,281,076

DATED : January 25, 1994

INVENTOR(S) : Marcus S. Lehman

It is certified that error appears in the above-identified patent and that said Letters Patent is hereby corrected as shown below:

Column 3, line 58, insert --the positions shown in Fig. Valves 101-104 are shifted to-- after the word "to".

Column 4, line 64, "133" should read --122--.

Signed and Sealed this

Sixth Day of September, 1994

*Attest:*

*Attesting Officer*

BRUCE LEHMAN

*Commissioner of Patents and Trademarks*